US007347034B1

(12) United States Patent
Kwon

(10) Patent No.: US 7,347,034 B1
(45) Date of Patent: Mar. 25, 2008

(54) SLEEVING EQUIPMENT FOR EGG PACKAGE

(76) Inventor: Dongheum Kwon, 2550 E. Cerritos Ave., Anaheim, CA (US) 92806

( * ) Notice: Subject to any disclaimer, the term of this patent is extended or adjusted under 35 U.S.C. 154(b) by 0 days.

(21) Appl. No.: 11/745,269

(22) Filed: May 7, 2007

(51) Int. Cl.
*B65B 13/00* (2006.01)
*B65B 53/02* (2006.01)

(52) U.S. Cl. ..... 53/542; 53/585; 53/292; 53/298

(58) Field of Classification Search ..... 53/292, 53/298, 585
See application file for complete search history.

(56) References Cited

U.S. PATENT DOCUMENTS 3,799,834 A * 3/1974 Horvath ..... 156/481
3,888,067 A * 6/1975 Cross et al. ..... 53/292
3,974,628 A * 8/1976 Konstantin ..... 53/291
4,055,934 A * 11/1977 Leveugle ..... 53/585
4,118,916 A * 10/1978 Fresnel ..... 53/292
4,149,357 A * 4/1979 Lucke ..... 53/585
6,955,033 B2 * 10/2005 Lortz ..... 53/585
6,996,954 B1 * 2/2006 Farley et al. ..... 53/459

* cited by examiner

*Primary Examiner*—John Sipos
(74) *Attorney, Agent, or Firm*—John K. Park; Park Law Firm

(57) ABSTRACT

Sleeving equipment for egg packages includes a sleeve dispenser that cuts and dispenses a sleeve one by one, a sleeve control jig that controls a sleeve that is dispensed by the sleeve dispenser, a first egg package conveying device that conveys egg packages before the sleeve is positioned around the egg package, an egg package inserter that inserts the egg package into the sleeve, a second egg package conveying device that conveys the egg package and the sleeve placed around the egg package and a heat tunnel that heat shrinks the sleeve whereby the sleeve is fixed to the egg package. The sleeve dispenser cuts and dispenses the sleeve in vertical direction, and the sleeve control jig rotates the sleeve into horizontal direction before the egg package inserter insert the egg package into the sleeve. The egg package inserter inserts the egg package into the sleeve horizontally.

8 Claims, 5 Drawing Sheets

SLEEVING EQUIPMENT FOR EGG PACKAGE

BACKGROUND OF THE INVENTION

The present invention relates to sleeving equipment for egg packages. More particularly, the present invention relates to sleeving equipment for egg packages that provides a shrink sleeve that can prevent accidental opening or tampering of egg packages.

An egg package is used to convey eggs from the producer to the consumer in a safe and stable state. Since the eggs are fragile and easy to be broken, an egg package is made with shock absorbing material such as molded fiberboard or foam plastic and has an upper part and a lower part that is usually connected with a hinge to allow access to the eggs packed.

The disadvantage of egg packages by prior art that they are often opened accidentally or tampered with by consumers and eggs may be broken by improper handling. This increases distribution cost of eggs and dissatisfaction of the customers. An egg package that has tamper proof function has long been in need.

SUMMARY OF THE INVENTION

The present invention contrives to solve the disadvantages of the prior art.

An objective of the invention is to provide sleeving equipment for egg packages that provides a sleeve on an egg package for tamper proofing.

Another objective of the invention is to provide sleeving equipment for egg packages that provides a sleeve on an egg package to prevent accidental opening of the package.

In order to achieve the above objective, the present invention provides a sleeving equipment for egg packages that includes a sleeve dispenser that is adapted to dispense a sleeve one by one by utilizing an internal cutting mechanism, a sleeve control jig that is adapted to control a sleeve that is dispensed by the sleeve dispenser, a first egg package conveying device that is adapted to convey one or more egg packages before the sleeve is positioned around the egg package, an egg package inserter that is adapted to insert the egg package into the sleeve, a second egg package conveying device that is adapted to convey the egg package and the sleeve placed around the egg package after the sleeve is positioned around the egg package, a heat tunnel that is adapted to heat shrink the sleeve whereby the sleeve is fixed to the egg package, and a third egg package conveying device that is adapted to move the egg package with the sleeve through the heat tunnel.

The sleeve is held by the sleeve control jig. The sleeve dispenser cuts and dispenses the sleeve in vertical direction, and the sleeve control jig rotates the sleeve into horizontal direction before the egg package inserter inserts the egg package into the sleeve. The egg package inserter inserts the egg package into the sleeve horizontally.

The sleeve control jig comprises a first arm and a second arm that is provided opposite to the first arm. The sleeve is held between the first arm and the second arm with vacuum applied on the first arm and the second arm. The first arm and the second arm are rotatable and retractable.

The sleeve control jig positions the sleeve to a predetermined position.

The sleeve control jig releases the sleeve after the egg package is inserted into the sleeve by retracting the first arm and the second arm.

The heat tunnel has inside temperature in a range from about 65 degree Celsius to about 90 degree Celsius and applies heat to the sleeve from about 4 to about 5 seconds.

The egg package inserter comprises a push stick(s) that is/are adapted to push the egg package into the sleeve.

The advantages of the present invention are: (1) tampering of an egg package is prevented; (2) accidental opening of an egg package is prevented; and (3) the sleeve may be used for high quality printing surface.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
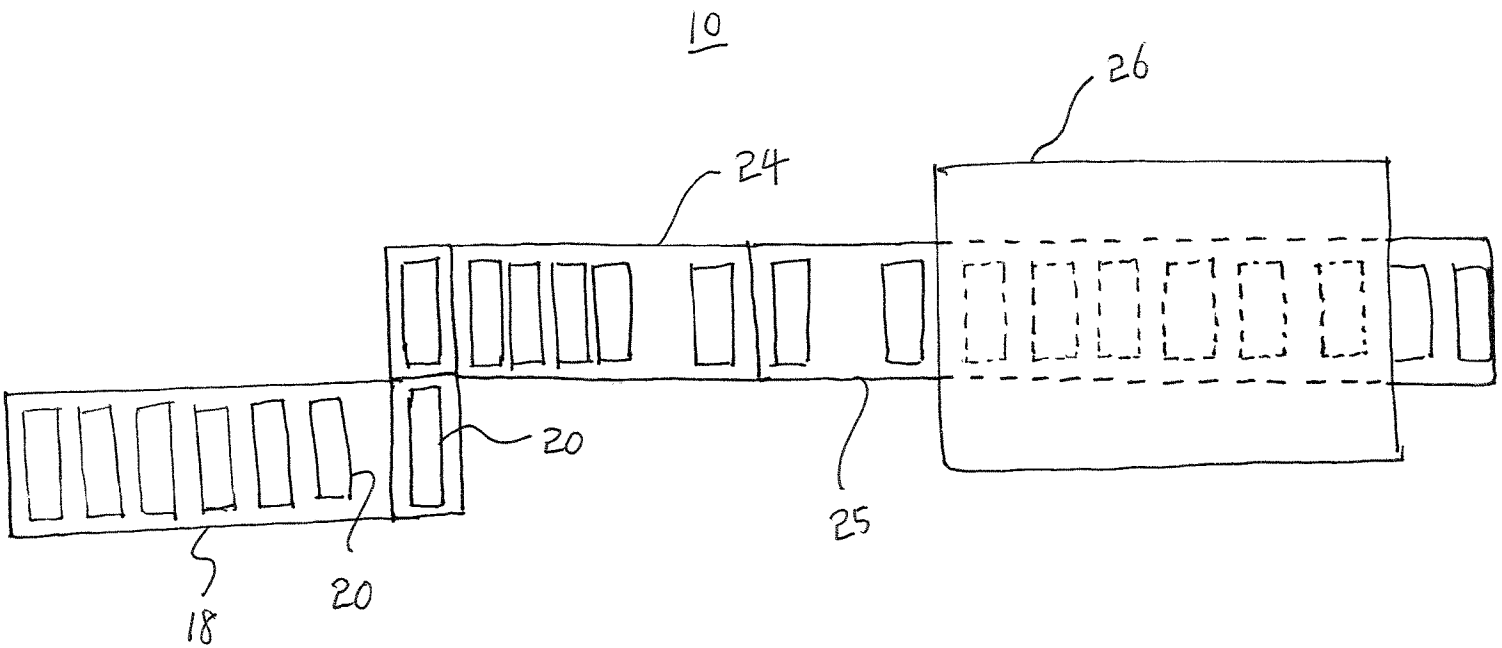
FIG. 1 is a plan view of a sleeving equipment according to the present invention.
Figure 2:
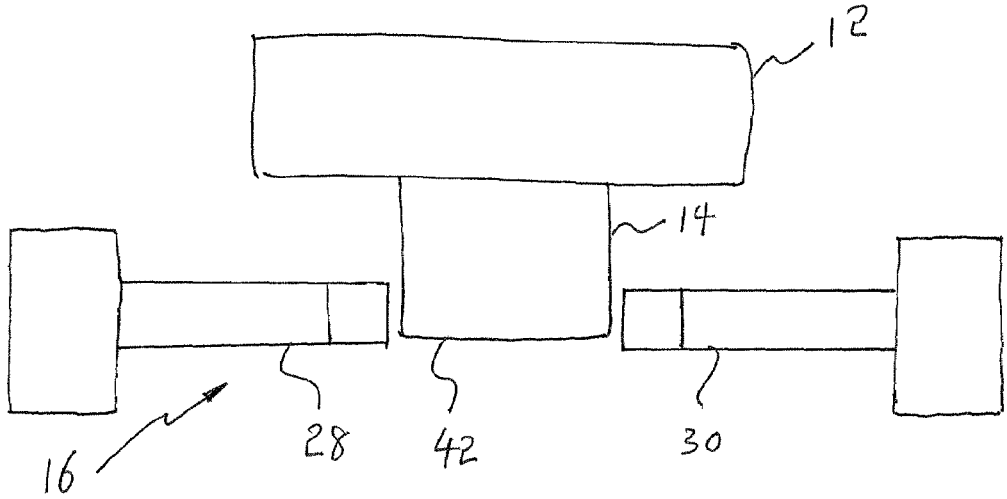
FIG. 2 is an elevation view of a sleeve control jig.

FIGS. 1 and 2 show a sleeving equipment 10 for egg packages that includes a sleeve dispenser 12 that is adapted to dispense a sleeve 14 one by one, a sleeve control jig 16 that is adapted to control the sleeve 14 that is dispensed by the sleeve dispenser 12, a first egg package conveying device 18 that is adapted to convey one or more egg packages 20 before the sleeve 14 is positioned around the egg package 20, an egg package inserter 22 (refer to FIG. 6) that is adapted to insert the egg package 20 into the sleeve 14, a second egg package conveying device 24 that is adapted to convey the egg package 20 and the sleeve 14 placed around the egg package 20 after the sleeve 14 is positioned around the egg package 20, a heat tunnel 26 that is adapted to heat shrink the sleeve 14 whereby the sleeve 14 is fixed to the egg package 20, and a third egg package conveying device 25 that is adapted to move the egg package with the sleeve through the heat tunnel 26.

The egg packages 20 are aligned while they are conveyed by the first egg package conveying device 18.

Figure 3:
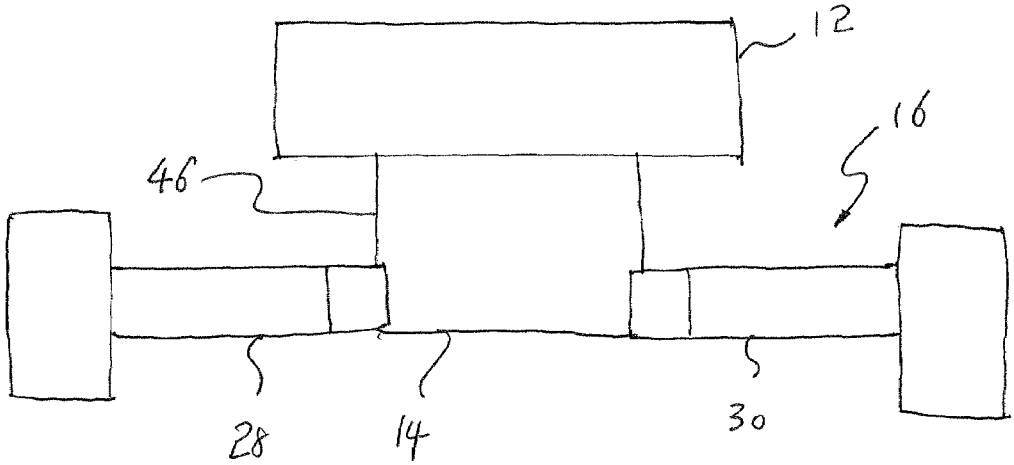
FIG. 3 is an elevation view of the sleeve control jig showing that a sleeve is held by the jig with vacuum.
Figure 4:
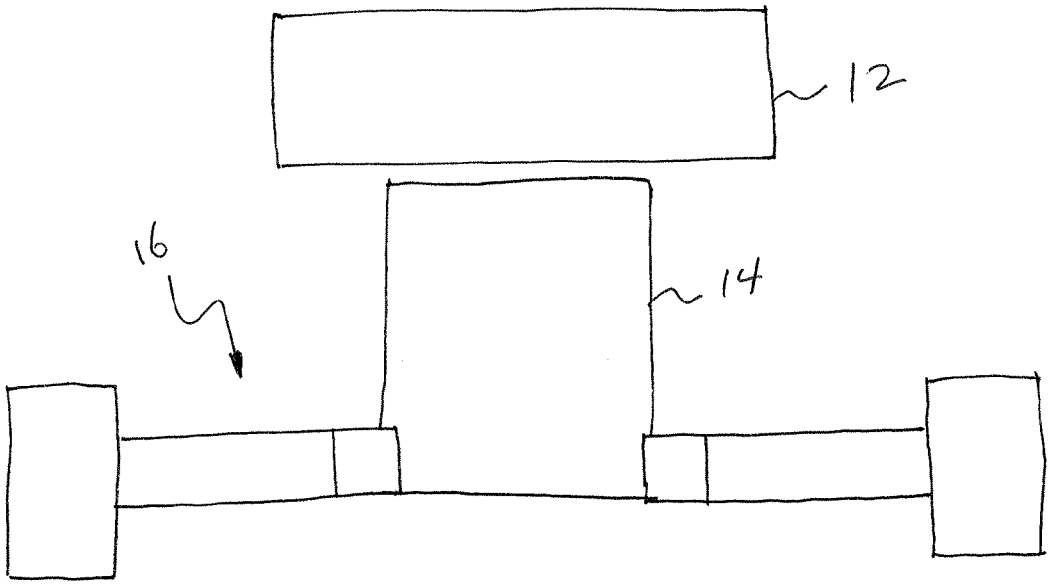
FIG. 4 is an elevation view of the sleeve control jig showing that the jig is lowered.
Figure 5:
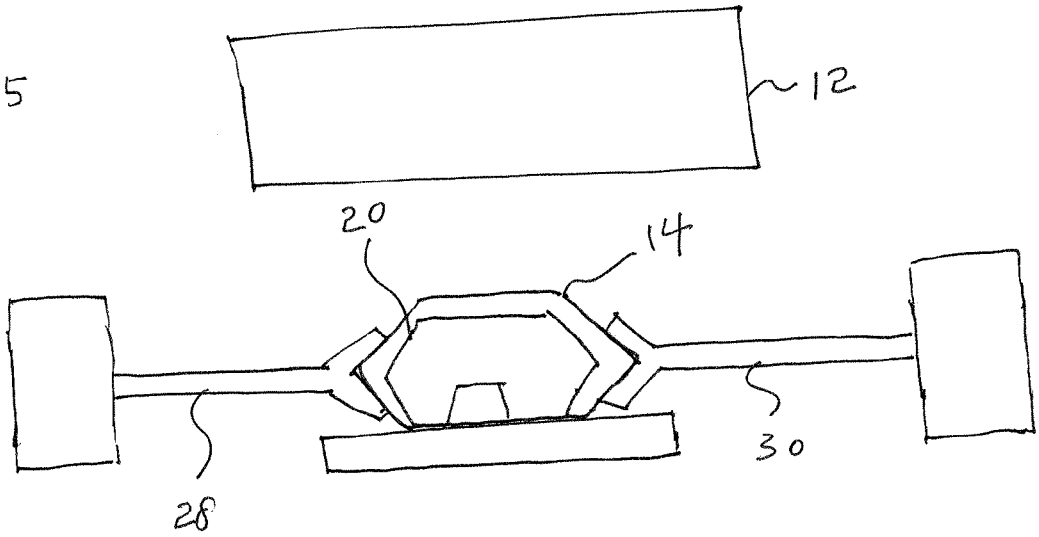
FIG. 5 is an elevation view of the sleeve control jig showing that the sleeve is rotated by 90 degrees.
Figure 6:
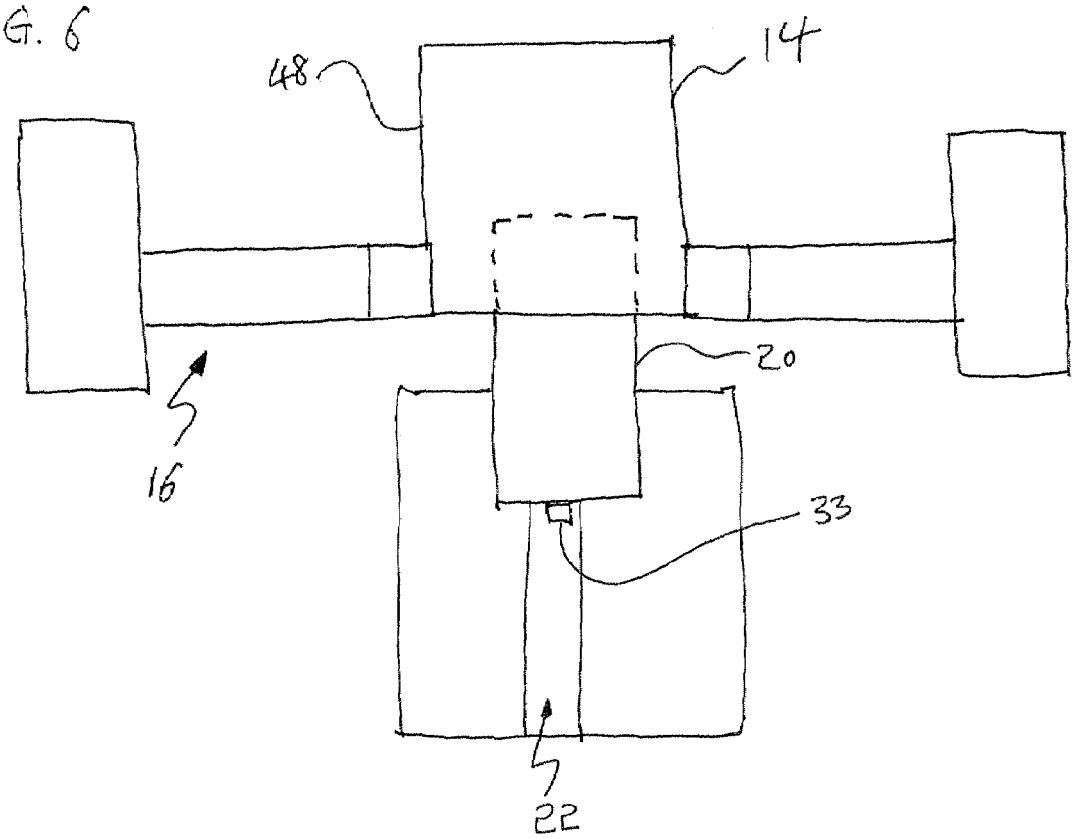
FIG. 6 is a plan view of the sleeve control jig showing the egg package is being inserted into the sleeve.

FIG. 3 shows that the sleeve 14 is held by the sleeve control jig 16. The sleeve dispenser 12 cuts and dispenses the sleeve 14 in vertical direction, and the sleeve control jig 16 rotates the sleeve 14 into horizontal direction before the egg package inserter 22 inserts the egg package 20 into the sleeve 14 as shown in FIGS. 4, 5 and 6. The egg package inserter 22 inserts the egg package 20 into the sleeve 14 horizontally. When the egg package 20 is inserted into the sleeve 14, product verification is performed to check proper matching of the sleeve and the egg package.

The sleeve control jig 16 comprises a first arm 28 and a second arm 30 that is provided opposite to the first arm 28. The sleeve 14 is held between the first arm 28 and the second arm 30 with vacuum applied on the first arm 28 and the second arm 30. The first arm 28 and the second arm 30 are rotatable and retractable.

The sleeve control jig 16 positions the sleeve 14 to a predetermined position. A stepping motor is used to feed the sleeve. When an eye mark is read by a sensor, the stepping motor stops to cut and feed the sleeve.

Figure 7:
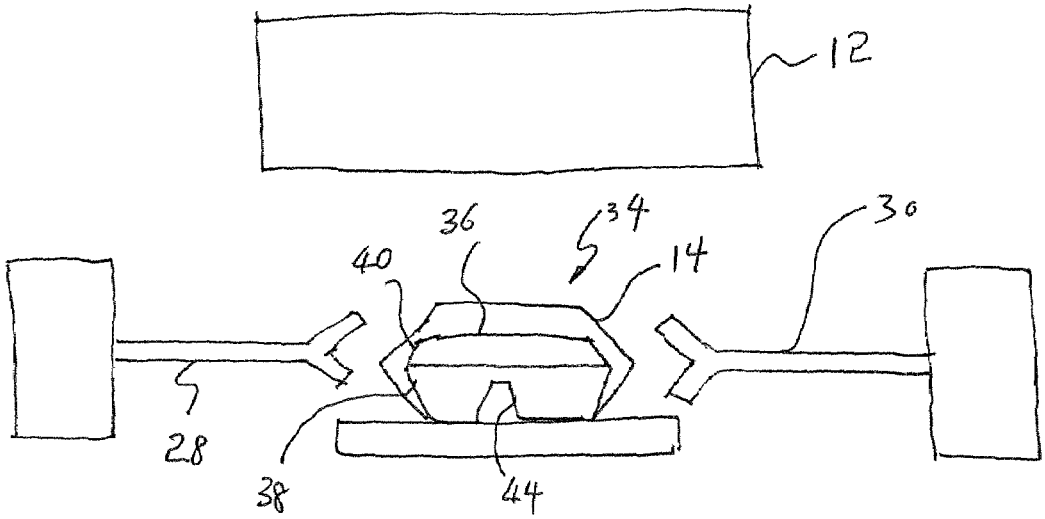
FIG. 7 is an elevation view of the sleeve control jig showing a first arm and a second arm are released from the sleeve.
Figure 8:
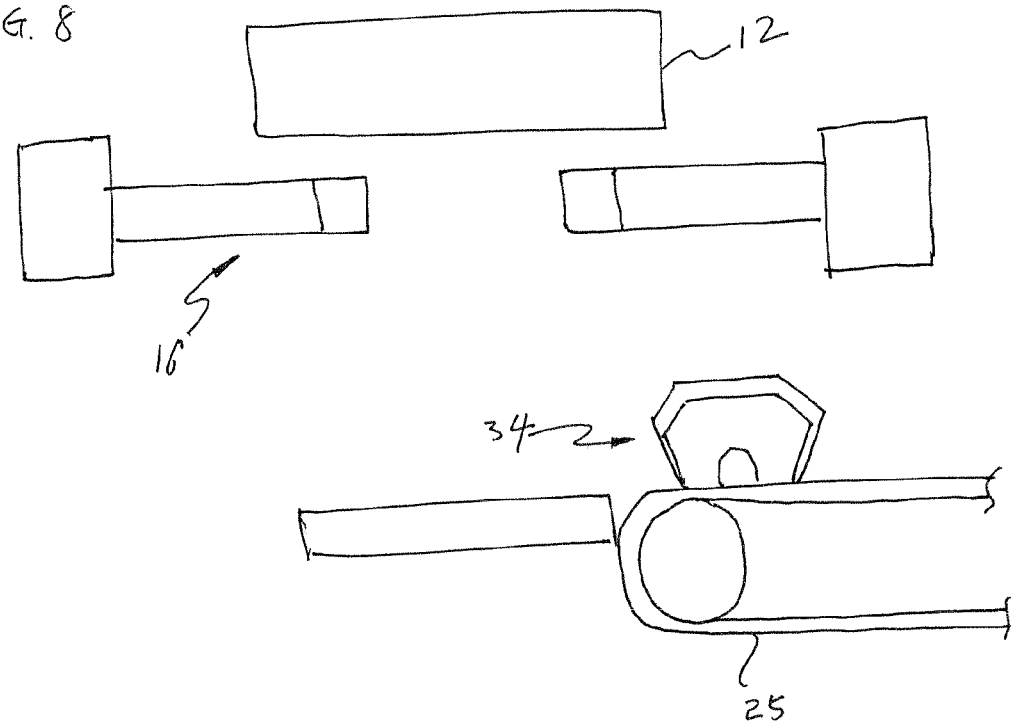
FIG. 8 is an elevation view of the sleeve control jig and a second egg package conveying device.

FIG. 7 shows that the sleeve control jig 16 releases the sleeve 14 after the egg package 20 is inserted into the sleeve 14 by retracting the first arm 28 and the second arm 30. FIG. 8 shows that the sleeve control jig 16 is returned after releasing the sleeve.

The heat tunnel 26 has inside temperature in a range from about 65 degree Celsius to about 90 degree Celsius and applies heat to the sleeve 14 from about 4 to about 5 seconds.

The egg package inserter 22 comprises a push stick(s) 33 that is/are adapted to push the egg package 20 into the sleeve 14.

Referring to FIG. 7, an egg package assembly 34 comprises the egg package or a protective case 36 that is adapted to contain predetermined number of eggs and the sleeve 14 that fixedly surrounds the protective case 36. The protective case 36 comprises a base 38 and a lid 40. Referring to FIG. 2, the sleeve 14 comprises a thin packing film 42.

The predetermined number may be 6, 12, 18, 24 or other number of eggs of commonly used egg packages. The base 38 or lid 40 of the protective case 36 comprise projections 44 that are adapted to separate eggs. Preferably, the base 38 and lid 40 of the protective case 36 are made of molded fiberboard.

The sleeve 14 comprises a heat shrink film 46. Preferably, the heat shrink film 46 is made of PVC, PET or OPS. The heat shrink film 46 has a thickness in a range from about 45 μL to about 60μ.

The heat shrink film 46 comprises has a shape of a tube 48 before it is shrunk. The length of the tube 48 is about the length of the protective case 36 and the width of the tube 48 is about 8 mm to about 14 mm greater than the width of the protective case 36.

Figure 9:
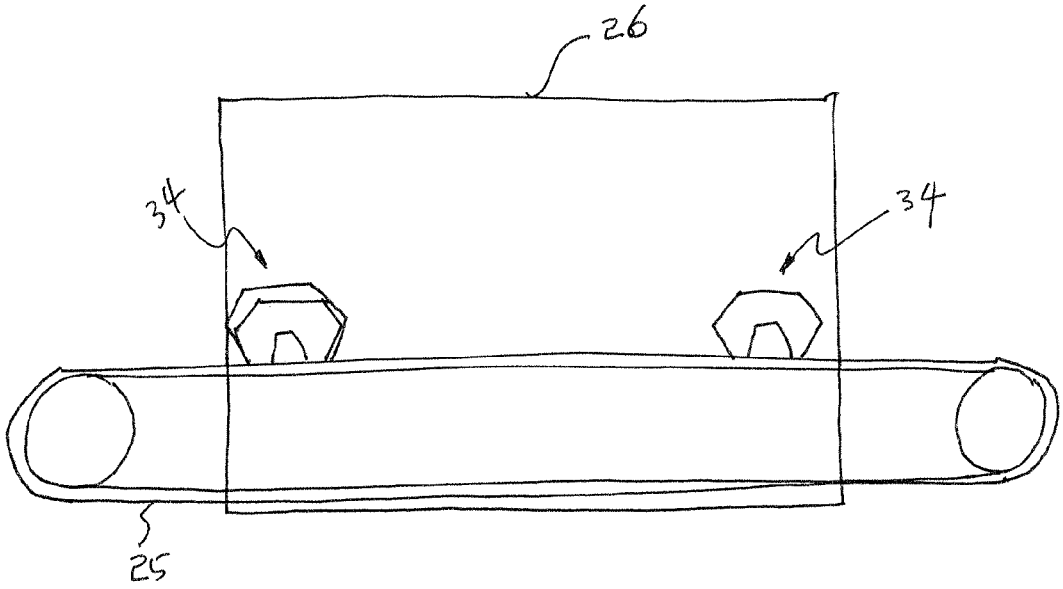
FIG. 9 is an elevation view of a third egg package conveying device and a heat tunnel.

Referring to FIG. 9, the heat shrink film 46 is shrunk by heating at temperature from about 65 Celsius to about 90 degree Celsius for about 4 to about 5 seconds in the heat tunnel 32.

The heat shrink film shrinks about 35% in width and no greater than 6% in length.

The present invention is further explained below.

The size of the shrink sleeve to be applied to the egg carton for purposes of tamper evidence, ensuring the carton remains closed in shipment and providing a surface for high quality printing to assist in the sales and marketing of the eggs in the carton is determined by the carton itself. The sleeve prior to application and shrinking would be cut to the exact length of the carton and would prior to that have been seamed into a tube that would be 8 mm to 14 mm greater than the circumference of the specific egg carton at it's widest point. The thickness of the sleeve material would be between 45μ to 60μ PVC, PET, PLA or OPS shrink film.

After the carton is inserted into the shrink sleeve it is conveyed into a 1500 mm dry heat tunnel with a temperature setting between 65° Celsius and 90° Celsius and will travel through the tunnel for four (4) to five (5) seconds. This will shrink the sleeve approximately 35% in the cross direction around the circumference of the carton and no greater than 6% in the machine direction or length of the carton allowing the majority of the vertical end walls of the carton to remain exposed. The sleeve will conform to the general shape of the egg carton.

The sleeves may be applied to cartons made of molded or formed fiberboard or various formed plastics the thickness of which is not critical to this application and is variable dependent upon the material and manufacturing specification of the carton. The egg carton size would be for six (6), twelve (12), eighteen (18) or twenty-four (24) pack cartons and specific size would be determined by the carton manufacturer, egg packer and or retailer.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A sleeving equipment for egg package comprising:

a) a sleeve dispenser that is adapted to cut and dispense a sleeve one by one in a vertical direction;

b) a sleeve control jig that is adapted to control a sleeve that is dispensed by the sleeve dispenser and rotate it into a horizontal direction;

c) a first egg package conveying device that is adapted to convey one or more egg packages before the sleeve is positioned around the egg package;

d) an egg package inserter that is adapted to insert the egg package into the sleeve, while the sleeve is held by the sleeve control jig in the horizontal direction;

e) a second egg package conveying device that is adapted to convey the egg package and the sleeve placed around the egg package after the sleeve is positioned around the egg package; and f) a heat tunnel that is adapted to heat shrink the sleeve whereby the sleeve is fixed to the egg package.

2. The sleeving equipment of claim 1, wherein the sleeve control jig comprises a first arm and a second arm that is provided opposite to the first arm, wherein the sleeve is held between the first arm and the second arm with vacuum applied on the first arm and the second arm, wherein the first arm and the second arm are rotatable and retractable.

3. The sleeving equipment of claim 2, wherein the sleeve control jig positions the sleeve to a predetermined position.

4. The sleeving equipment of claim 2, wherein the sleeve control jig releases the sleeve after the egg package is inserted into the sleeve by retracting the first arm and the second arm.

5. The sleeving equipment of claim 1, wherein the heat tunnel has inside temperature in a range from about 65 degree Celsius to about 90 degree Celsius.

6. The sleeving equipment of claim 5, wherein the heat tunnel applies heat to the sleeve from about 4 to about 5 seconds.

7. The sleeving equipment of claim 1, wherein the egg package inserter comprises a push stick(s) that is/are adapted to push the egg package into the sleeve.

8. The sleeving equipment of claim 1, further comprising a third egg package conveying device that is adapted to move the egg package with the sleeve through the heat tunnel.

* * * * *